US007360265B2

(12) United States Patent
Lamer

(10) Patent No.: US 7,360,265 B2
(45) Date of Patent: Apr. 22, 2008

(54) LATERAL CONFINEMENT DEVICE FOR USE IN CHILDREN'S BED

(76) Inventor: Patrick Lamer, 10345, Perras #8, Montreal, Quebec (CA) H1C 2A3

( * ) Notice: Subject to any disclaimer, the term of this patent is extended or adjusted under 35 U.S.C. 154(b) by 0 days.

(21) Appl. No.: 11/599,824

(22) Filed: Nov. 15, 2006

(65) Prior Publication Data

US 2007/0107132 A1 May 17, 2007

Related U.S. Application Data

(60) Provisional application No. 60/736,279, filed on Nov. 15, 2005.

(51) Int. Cl.
*A47D 15/00* (2006.01)
*A47D 7/00* (2006.01)
*A47C 21/08* (2006.01)

(52) U.S. Cl. ..... 5/655; 5/424; 5/425

(58) Field of Classification Search ..... 5/424, 5/425, 427, 428, 655, 631
See application file for complete search history.

(56) References Cited

U.S. PATENT DOCUMENTS

| | | | | |
|---|---|---|---|---|
| 5,216,772 | A * | 6/1993 | Clute | 5/655 |
| 5,272,780 | A | 12/1993 | Clute | |
| D343,756 | S | 2/1994 | Sher | |
| 5,367,730 | A | 11/1994 | Sher | |
| 5,450,640 | A * | 9/1995 | Patton et al. | 5/655 |
| 5,499,418 | A * | 3/1996 | Tan et al. | 5/655 |
| 5,581,832 | A | 12/1996 | Bridley | |
| 6,097,294 | A | 8/2000 | Hilton | |
| 6,877,176 | B2 | 4/2005 | Houghtelling | |

* cited by examiner

*Primary Examiner*—Michael Trettel

(57) ABSTRACT

A lateral confinement device for use in children's bed comprising a pair of units each consisting of a lateral mound and each mound having a blanketing part extending therefrom. In use, these blanketing parts overlap so as to adjust for width and, most importantly, the child sleeps on top of both blanketing parts so that its own weight holds the mounds at the selected distance. Additionally, hook and loop means insure that the position is maintained when the child is not in bed or during ingresses and egresses or when changing bedsheets and such.

6 Claims, 4 Drawing Sheets

LATERAL CONFINEMENT DEVICE FOR USE IN CHILDREN'S BED

This application claims priority based on provisional patent 60/736,279 filed Nov. 15, 2005.

FIELD OF THE INVENTION

The invention relates generally to confinement devices but more particularly to a device to stop children from falling off of their beds.

BACKGROUND OF THE INVENTION

The problem of children falling out of bed is fairly common and devices have been developed over the years to restrain children within a bed. This of course starts with baby cribs but extends to the use of removable <<barricades>> that can be installed on regular beds. Various types of cushions have been developed that can restrain the movements of infants, these inventions became popular when it was thought that sudden infant death syndrome was caused by an infant adopting a certain body position while sleeping. So these devices were developed to reduce movement.

There are some types of larger cushioning or at least small cushioning devices that could be scaled up to cover the needs of grown children and preteens who tend to move a lot in their sleep and who are at risk of falling off their bed.

Unfortunately, the devices which merely use hook and loop means to affix themselves to blankets do not offer a strong enough holding capacity for larger children who exert more force upon them and ultimately render these devices impractical for other than infants. There is therefore a need for a better child restraining or confining device for use in a bed.

Prior Art Capability and Motiviations, as Helping to Show Patentability Here

Even in hindsight consideration of the present invention to determine its inventive and novel nature, it is not only conceded but emphasized that the prior art had many details usable in this invention, but only if the prior art had had the guidance of the present invention, details of both capability and motivation.

That is, it is emphasized that the prior art had/or knew several particulars which individually and accumulatively show the non-obviousness of this combination invention. E.g., a) The use of confinement devices for bed;
b) The nature of an invention as being a "novel combination", in spite of existence of details separately, is especially significant here where the novelty is of the plurality of concepts, i.e., the use of confinement along with the use of soft padding;
c) The addition of providing a holding down means using the user's own weight;
d) The matter of particular cost-factors, in a detailed form which would surely convey the realization of the huge costs involved in building confinement devices using a variety of structural components in order to provide a means of securing the device;
e) The ease of tooling for the present invention has surely given manufacturers ample incentive to have made modifications for commercial competitiveness, if the concepts had been obvious;
f) The prior art has always had sufficient skill to make many types confinement devices, more than ample skill to have achieved the present invention, but only if the concepts and their combinations had been conceived;
g) Substantially all of the operational characteristics and advantages of details of the present invention, when considered separately from one another and when considered separately from the present invention's details and accomplishment of the details, are within the skill of persons of various arts, but only when considered away from the integrated and novel combination of concepts which by their cooperative combination achieve this advantageous invention;
h) The details of the present invention, when considered solely from the standpoint of construction, are exceedingly simple, basically cushions equipped with blanketing parts and the matter of simplicity of construction has long been recognized as indicative of inventive creativity;
i) Similarly, and a long-recognized indication of inventiveness of a novel combination, is the realistic principle that a person of ordinary skill in the art, as illustrated with respect to the claimed combination as differing in the stated respects from the prior art both as to construction and concept, is presumed to be one who thinks along the line of conventional wisdom in the art and is not one who undertakes to innovate; and
j) The predictable benefits from a novel device for confining people within a bed having the features of this invention would seem sufficiently high that others would have been working on this type of product, but only if the concepts which it presents had been conceived.

Accordingly, although the prior art has had capability and motivation, amply sufficient to presumably give incentive to the development a product according to the present invention, the fact remains that this invention awaited the creativity and inventive discovery of the present inventor. In spite of ample motivation, the prior art did not suggest this invention.

Prior Art as Particular Instances of Failure to Provide This Novel Product and Installation Method In view of the general advantages, of the present invention as an improved embodiment of the prior art, it may be difficult to realize that the prior art has not conceived of the combination purpose and achievement of the present invention, even though the need children's safety is a known requested commodity for people nowadays. Some devices conceived for infants are designed to immobilize the infant as a means of preventing sudden infant death syndrome and as such, a simple scaling up in size of the invention is insufficient to achieve the teachings of this instant invention since a simple sizing up would provide for an invention that immobilizes children and pre teens, which is not the purpose of this instant invention. Also, although other inventions provide for simple means, such as hook and loop means for holding cushions, these cushion holding means are not secure since one kick can dislodge the cushion from the hook and loop means.

Other considerations, as herein mentioned, when realistically evaluated show the inventive nature of the present invention, a change in concept which the prior patent and other prior art did not achieve.

Summary of the Prior Art's Lack of Suggestions of the Concepts of the Invention's Combination And the existence of such prior art knowledge and related ideas embodying such various features is not only conceded, it is emphasized; for as to the novelty here of the combination, of the invention as considered as a whole, a contrast to the prior art helps also to remind of needed improvement, and the advantages and the inventive significance of the present concepts. Thus, as shown herein as a contrast to all the prior art, the inventive significance of the present concepts as a combination is emphasized, and the nature of the concepts and their results can perhaps be easier seen as an invention.

Although varieties of prior art are conceded, and ample motivation is shown, and full capability in the prior art is conceded, no prior art shows or suggests details of the overall combination of the present invention, as is the proper and accepted way of considering the inventiveness nature of the concepts.

That is, although the prior art may show an approach to the overall invention, it is determinatively significant that none of the prior art shows the novel and advantageous concepts in combination, which provides the merits of this invention, even though certain details are shown separately from this accomplishment as a combination.

And the prior art's lack of an invention of an economical, easy to install, easy to adjust lateral confinement device for use in children's bed achieving a practical and reliable functionality, and other advantages of the present invention, which are goals only approached by the prior art, must be recognized as being a long-felt need now fulfilled.

Accordingly, the various concepts and components are conceded and emphasized to have been widely known in the prior art as to various installations; nevertheless, the prior art not having had the particular combination of concepts and details as here presented and shown in novel combination different from the prior art and its suggestions, even only a fair amount of realistic humility, to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

FEATURES AND ADVANTAGES OF THE INVENTION

In view of the foregoing disadvantages inherent in the known devices now present in the prior art, the present invention, which will be described subsequently in greater detail, is to provide objects and advantages which are:

to provide for an improved lateral confinement device for use in children's bed.

to provide for an improved lateral confinement device that is transportable.

to provide for an improved lateral confinement device in which only one side can be used such as when a bed is against the wall.

to provide for an improved lateral confinement device in which the padding can be removed so that the fabric can be machine washed.

SUMMARY OF THE INVENTION

To attain these ends, the present invention generally comprises a pair of units and each unit consists of a lateral mound. Each mound has a blanketing part extending from the mound. The blanketing parts overlap so as to adjust for width within the bed. The weight of a user is used as a means for holding the mounds at a preselected relative distance. Hook and loop means provide additional retention means to maintain the preselected relative distance.

In an alternate embodiment, a flap extending integrally from the external side of the mound is used for tucking between a mattress and boxspring.

In yet another alternate embodiment, a blanketing part zipper located at the junction of the mound and the blanketing part is used to facilitate the removal of the blanketing part from the mound.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION

Figure 1:
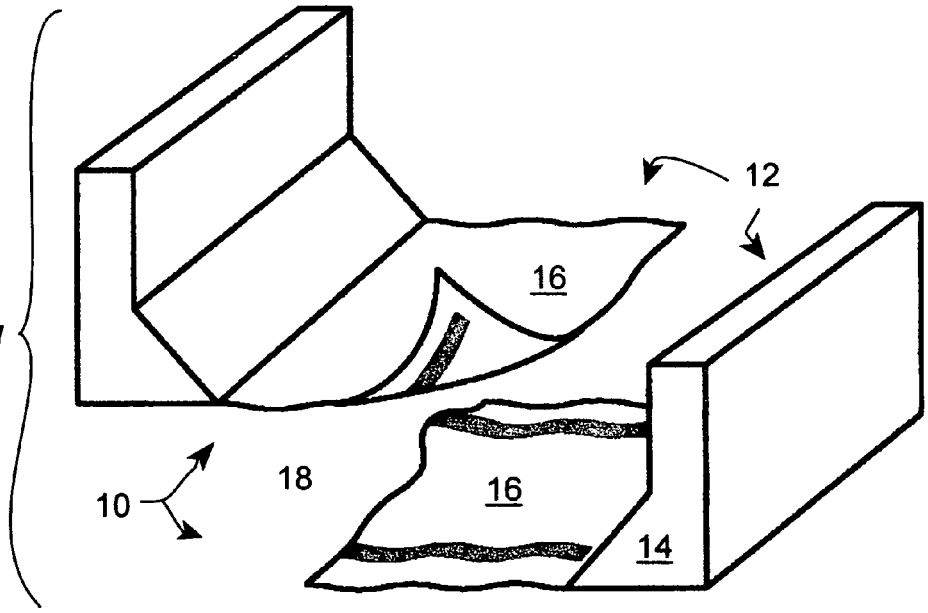
FIG. 1 Perspective view of both elements separated, showing the hook and loop means.
Figure 2:
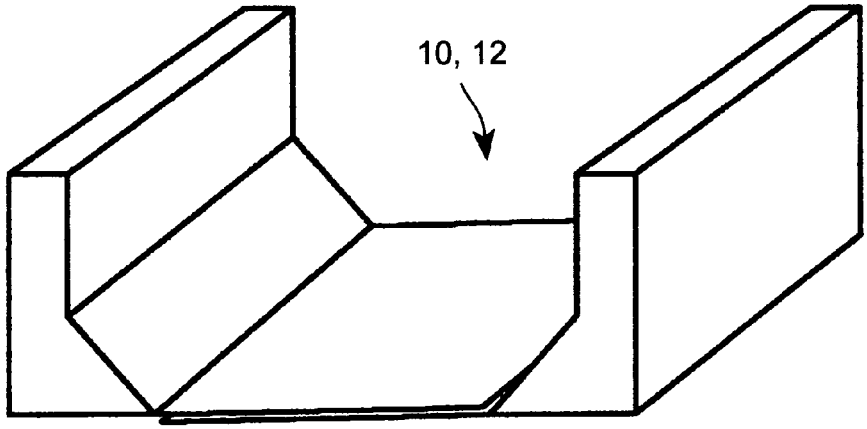
FIG. 2 Perspective view of both elements joined together, ready for use.
Figure 3A:
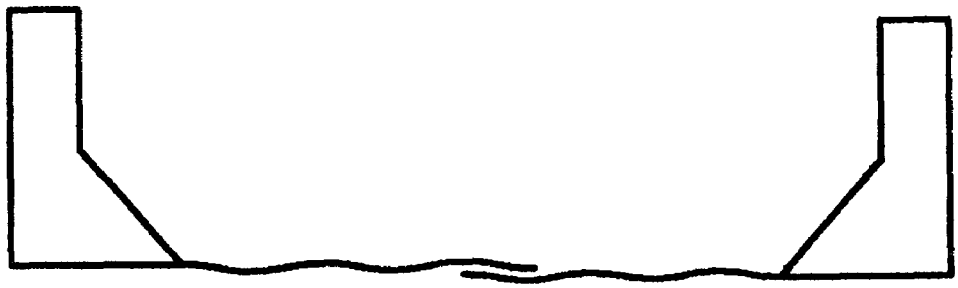
FIGS. 3A-3B Front view of the device showing how one can adjust the width FIG. 4 Perspective view favoring the bottom and showing a zipper.
Figure 3B:
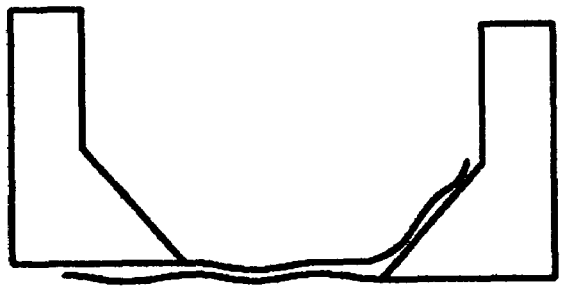
Figure 4:
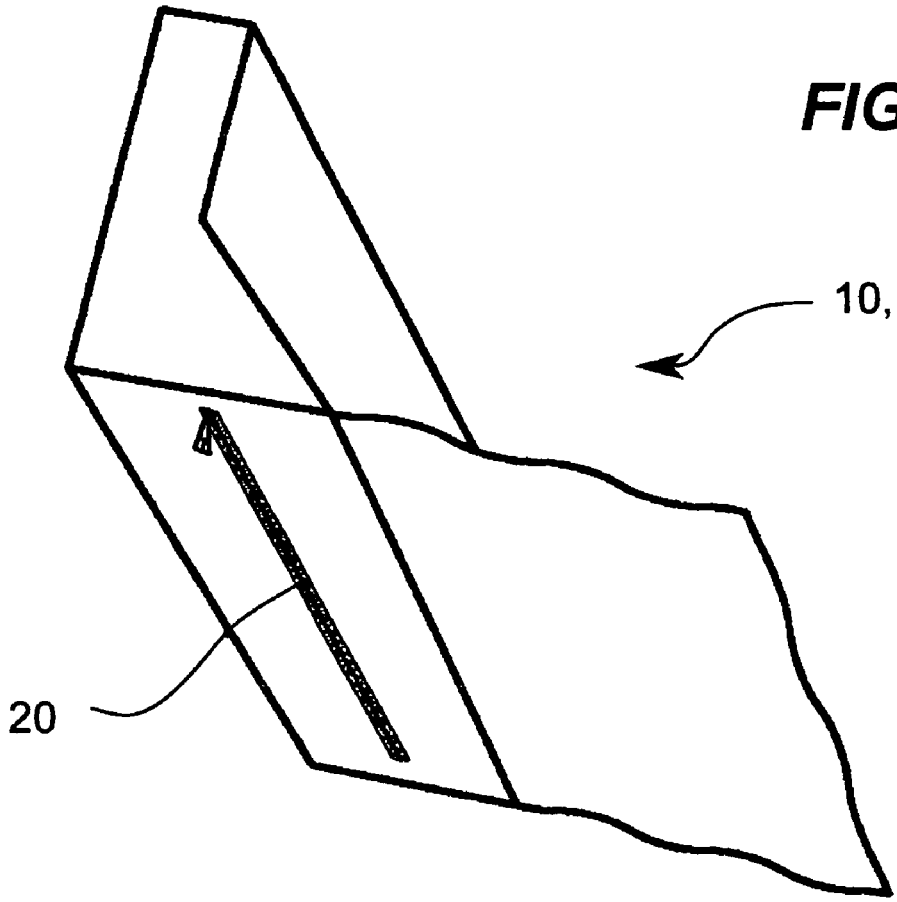

A lateral confinement device (10) comprises a pair of units (12), each unit (12) consisting of a lateral mound (14) and each mound (14) having a blanketing part (16) extending from the mound (14). In use, these blanketing parts (16) overlap so as to adjust for width as seen in FIGS. 3*a-b*. As the child sleeps over both blanketing parts (16), its own weight is used as a means for holding the mounds (14) at a preselected relative distance. Hook and loop means (18) insure that the relative distance is maintained when the child is not in bed. The mounds (14) are filled with soft and resilient material such as foam and the rest of the device (10) is made out of fabric as is generally known in the art of cushion making or upholstery. The configuration of the top part of the mounds (14) can vary so that instead of being linear it is curved or have some sort of pattern so as to represent figures such as animals or objects. Pretty much any, shape as well as color, pattern or design can of course be incorporated into the device (10) within the scope of the invention as long as the interior (11) of the mounds (14) is set at an angle and not a vertical so that if a user lands his face into the interior (11) there is no risk of suffocation. The outside (13) is preferably vertical so as to reduce the space requirement of the device (10) since giving it an angle would require more width but this is mostly a practical concern and not a patentable limitation. A closure means (20) such as a zipper is situated underneath the mound (14) and allows for the foam filling to be taken out so that only the fabric part is put inside a washing machine.

In one variation of the embodiment, a flap (22) is used for tucking between a mattress and boxspring (not shown) so as to further secure the external side of the mound (14).

In yet another variation of the embodiment, a blanketing part zipper (24) is used to facilitate the removal of the blanketing part since it may require more frequent washing than the mounds (14).

Figure 5:
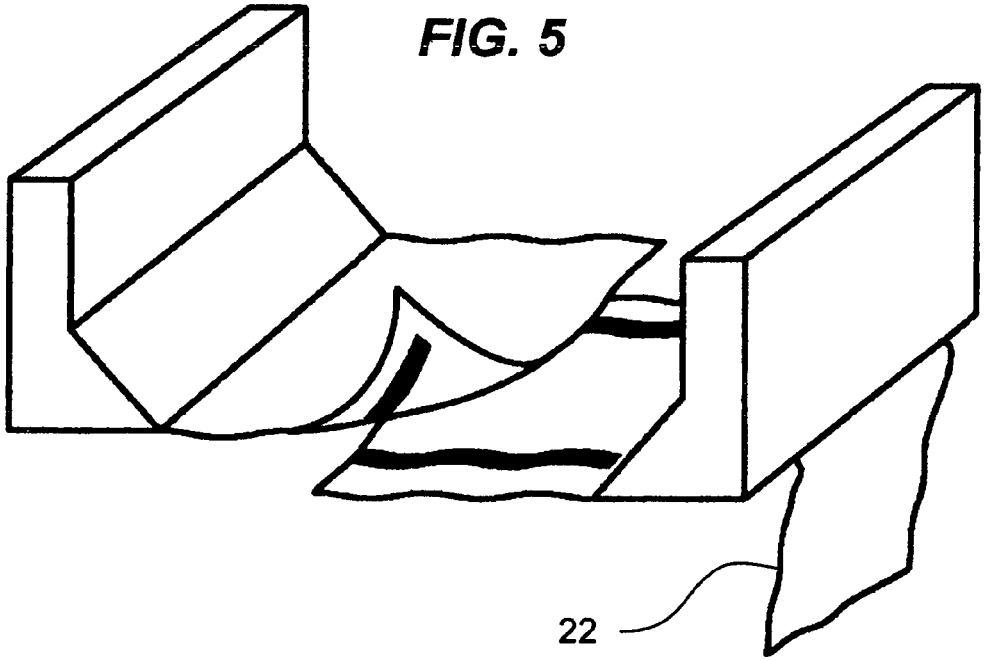
FIG. 5 Perspective view showing an embodiment having a flap.
Figure 6:
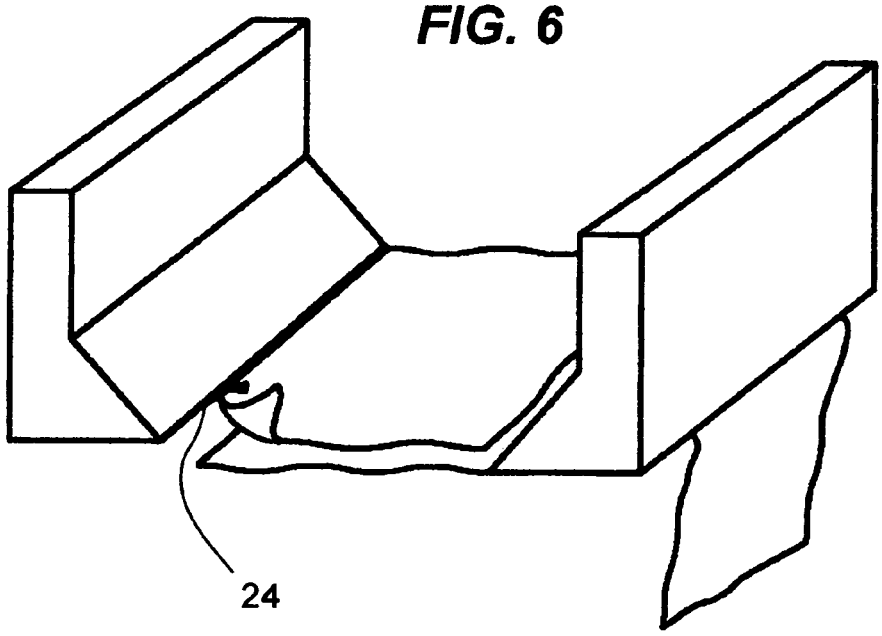
FIG. 6 Perspective view showing an embodiment having a blanketing part zipper.

These variations in embodiments can be used in combination as per FIG. 6 or not as per FIG. 5.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A lateral confinement device for bed comprising:

a pair of units and each said unit consisting of a lateral mound;

each said mound having a blanketing part extending from said mound;

said blanketing parts overlapping so as to adjust for width;

the weight of a user being used as a means for holding said mounds at a preselected relative distance;

releasably detachable means for providing additional retention means to maintain said preselected relative distance;

a flap extending integrally from an external side of said mound and is used for tucking between a mattress and box spring.

2. A lateral confinement device for bed as in claim 1 wherein:

said releasably detachable means in the form of hook and loop.

3. A lateral confinement device for bed comprising:

a pair of units and each said unit consisting of a lateral mound;

each said mound having a blanketing part extending from said mound;

said blanketing parts overlapping so as to adjust for width;

the weight of a user being used as a means for holding said mounds at a preselected relative distance;

releasably detachable means for providing additional retention means to maintain said preselected relative distance;

a blanketing part zipper located at the junction of said mound and said blanketing part to facilitate the removal of said blanketing part from said mound.

4. A lateral confinement device for bed as in claim 3 wherein:

a flap extending integrally from the external side of said mound and is used for tucking between a mattress and box spring.

5. A lateral confinement device for bed as in claim 4 wherein:

said releasably detachable means in the form of hook and loop.

6. A lateral confinement device for bed as in claim 3 wherein:

said releasably detachable means in the form of hook and loop.

* * * * *